US007452110B2

(12) United States Patent
Chen

(10) Patent No.: US 7,452,110 B2
(45) Date of Patent: Nov. 18, 2008

(54) LIGHT EMITTING DEVICE

(76) Inventor: Kuei-Fang Chen, No. 59, Lane 496, Ninpu S. Rd., Hsinchu (TW)

( * ) Notice: Subject to any disclaimer, the term of this patent is extended or adjusted under 35 U.S.C. 154(b) by 84 days.

(21) Appl. No.: 11/531,831

(22) Filed: Sep. 14, 2006

(65) Prior Publication Data

US 2007/0098334 A1 May 3, 2007

(30) Foreign Application Priority Data

Oct. 31, 2005 (CN) ..... 94 1 38111

(51) Int. Cl.
*F21V 7/00* (2006.01)

(52) U.S. Cl. ..... 362/294; 362/373

(58) Field of Classification Search ..... 362/373, 362/294; 257/98, 99; 165/80.2, 80.3, 185; 174/252

See application file for complete search history.

(56) References Cited

U.S. PATENT DOCUMENTS 5,070,936 A * 12/1991 Carroll et al. ..... 165/80.4
6,296,376 B1 * 10/2001 Kondo et al. ..... 362/310
6,428,189 B1 * 8/2002 Hochstein ..... 362/373
6,561,690 B2 * 5/2003 Balestriero et al. ..... 362/555
6,791,183 B2 * 9/2004 Kanelis ..... 257/718
6,936,855 B1 * 8/2005 Harrah ..... 257/88
7,198,387 B1 * 4/2007 Gloisten et al. ..... 362/294
2001/0030866 A1 * 10/2001 Hochstein ..... 362/294
2003/0156416 A1 * 8/2003 Stopa et al. ..... 362/294
2004/0233672 A1 * 11/2004 Dubuc ..... 362/294
2005/0023551 A1 * 2/2005 Mizuyoshi ..... 257/99
2006/0146502 A1 * 7/2006 Mayer ..... 361/720
2006/0187660 A1 * 8/2006 Liu ..... 362/294

* cited by examiner

*Primary Examiner*—John A Ward
(74) *Attorney, Agent, or Firm*—Darby & Darby P.C.

(57) ABSTRACT

A light emitting assembly includes: a heat sink including a base wall and two opposite retaining walls extending upright from the base wall and defining respectively two retaining grooves, each of the retaining walls having a top wall portion confining a top side of a respective one of the retaining grooves; a mounting seat having two opposite wings extending respectively into the retaining grooves; and a light emitting device mounted on the mounting seat and having a bottom wall extending through the mounting seat to abut against the base wall of the heat sink. Each of the wings of the mounting seat is formed with an elastic protrusion that abuts resiliently against the top wall portion of a respective one of the retaining walls.

10 Claims, 15 Drawing Sheets

LIGHT EMITTING DEVICE

CROSS-REFERENCE TO RELATED APPLICATION

This application claims priority of Taiwanese Application No. 094138111, filed on Oct. 31, 2005.

BACKGROUND OF THE INVENTION

1. Field of the Invention

The invention relates to a light emitting device, more particularly to a light emitting device having a heat sink with two retaining grooves and a mounting seat with two wings extending into the retaining grooves, respectively.

2. Description of the Related Art

Conventional light emitting assembly normally includes a plurality of light emitting devices mounted on a circuit board, and a fined heat sink for dissipating heat resulting from the light emitting devices. Attachment of the light emitting devices to the circuit board is normally achieved through thermally conductive paste, and attachment of the circuit board to the heat sink is achieved through silicone adhesive. As such, heat dissipating efficiency of the conventional light emitting assembly is poor due to the inclusion of the thermally conductive paste and the silicone adhesive, which, in turn, results in a decrease in the service life of the light emitting assembly. In addition, since the light emitting devices are adhered to the circuit board, replacement of a damaged one of the light emitting devices on the circuit board is relatively inconvenient.

SUMMARY OF THE INVENTION

Therefore, the object of the present invention is to provide a light emitting assembly that is capable of overcoming the aforesaid drawbacks of the prior art.

According to this invention, there is provided a light emitting assembly that comprises: a heat sink including a base wall and two opposite retaining walls extending upright from the base wall and defining respectively two retaining grooves, each of the retaining walls having a top wall portion confining a top side of a respective one of the retaining grooves; a mounting seat having two opposite wings extending oppositely and respectively into the retaining grooves; and a light emitting device mounted on the mounting seat between the wings and having a bottom wall extending through the mounting seat to abut against the base wall of the heat sink. Each of the wings of the mounting seat is formed with an elastic protrusion that abuts resiliently against the top wall portion of a respective one of the retaining walls, thereby resulting in a pushing force acting on the mounting seat to press the bottom wall of the light emitting device against the base wall of the heat sink.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
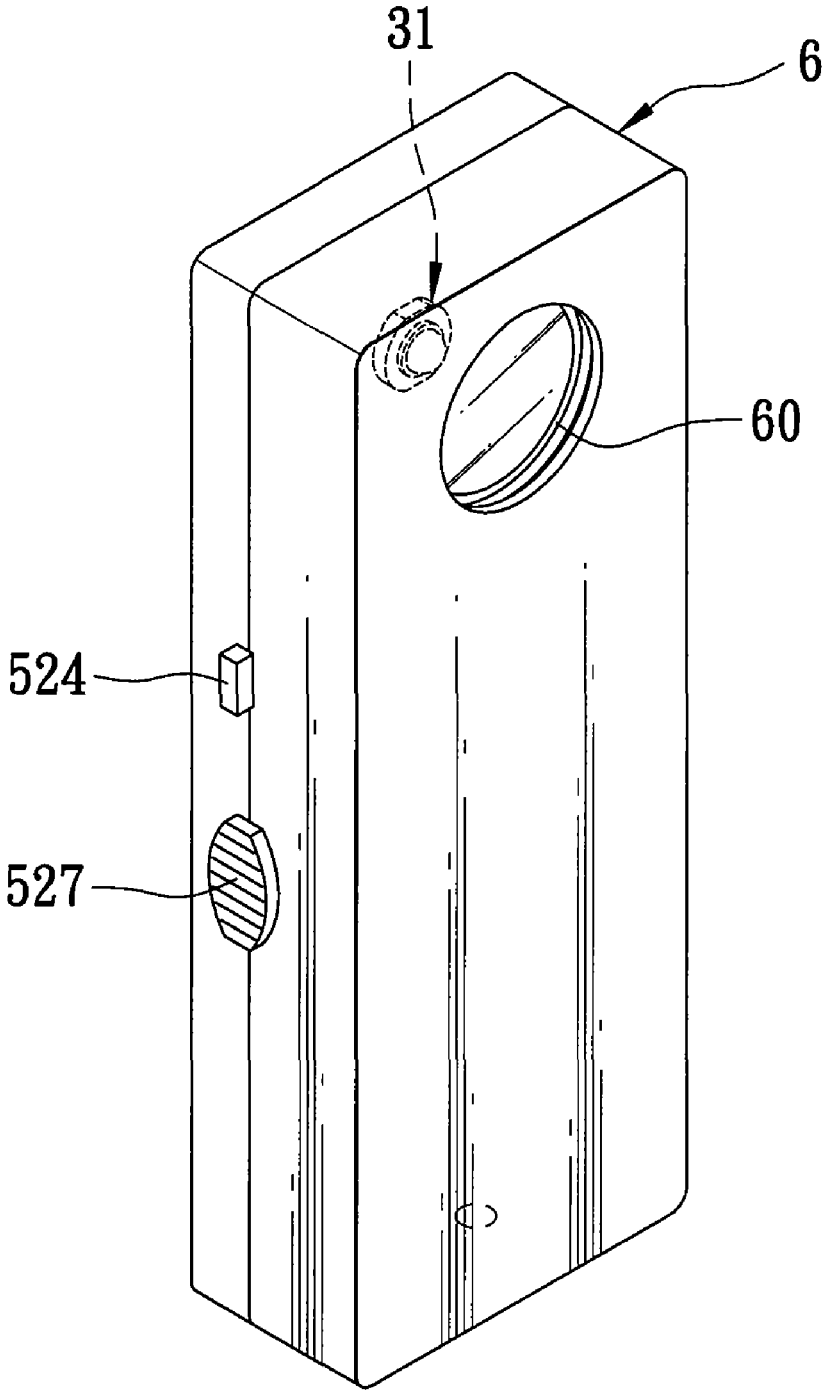
FIG. 1 is a perspective view of the first preferred embodiment of a light emitting assembly according to this invention.
Figure 2:
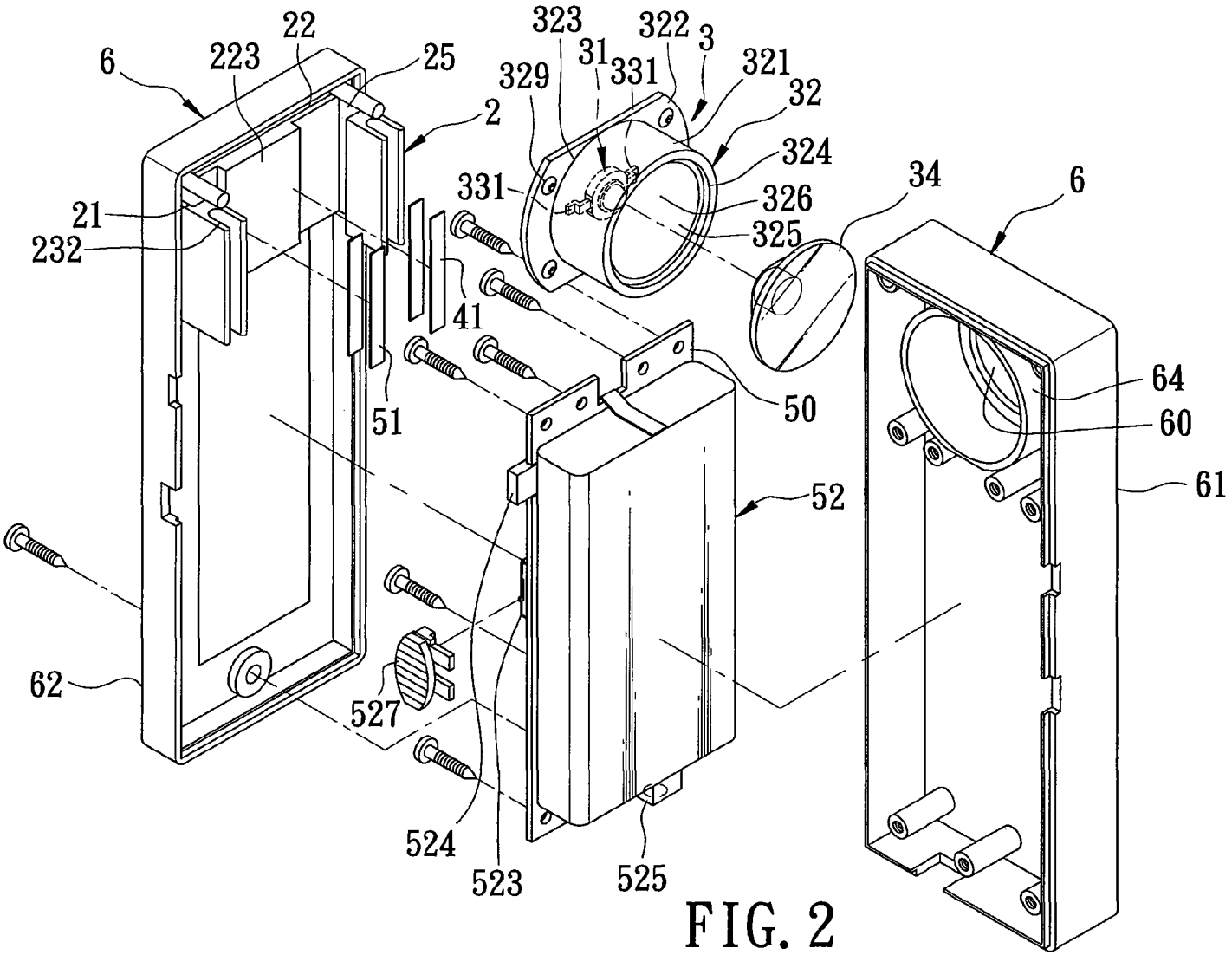
FIG. 2 is an exploded perspective view of the first preferred embodiment.
Figure 3:
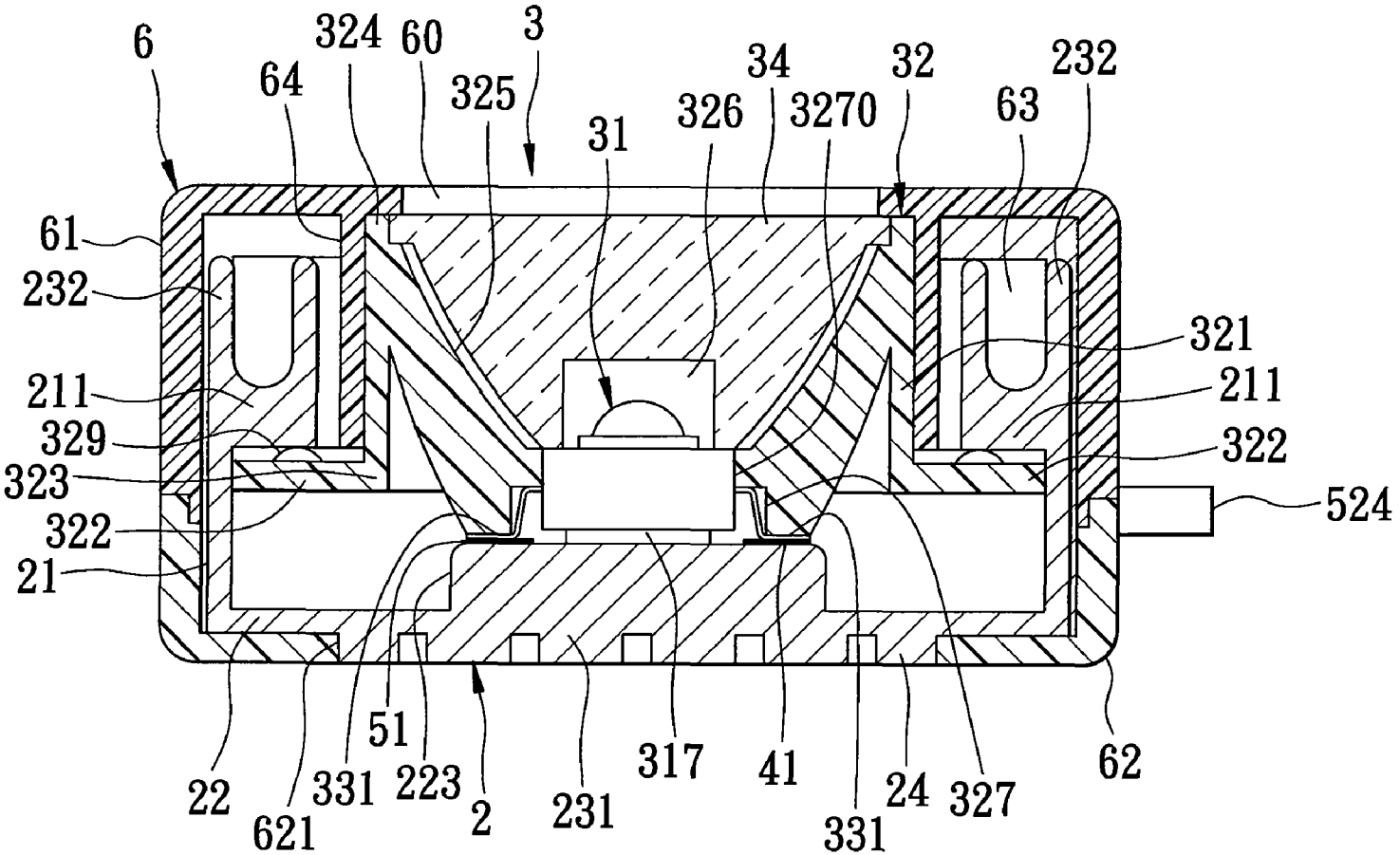
FIG. 3 is a sectional view of the first preferred embodiment.
Figure 4:
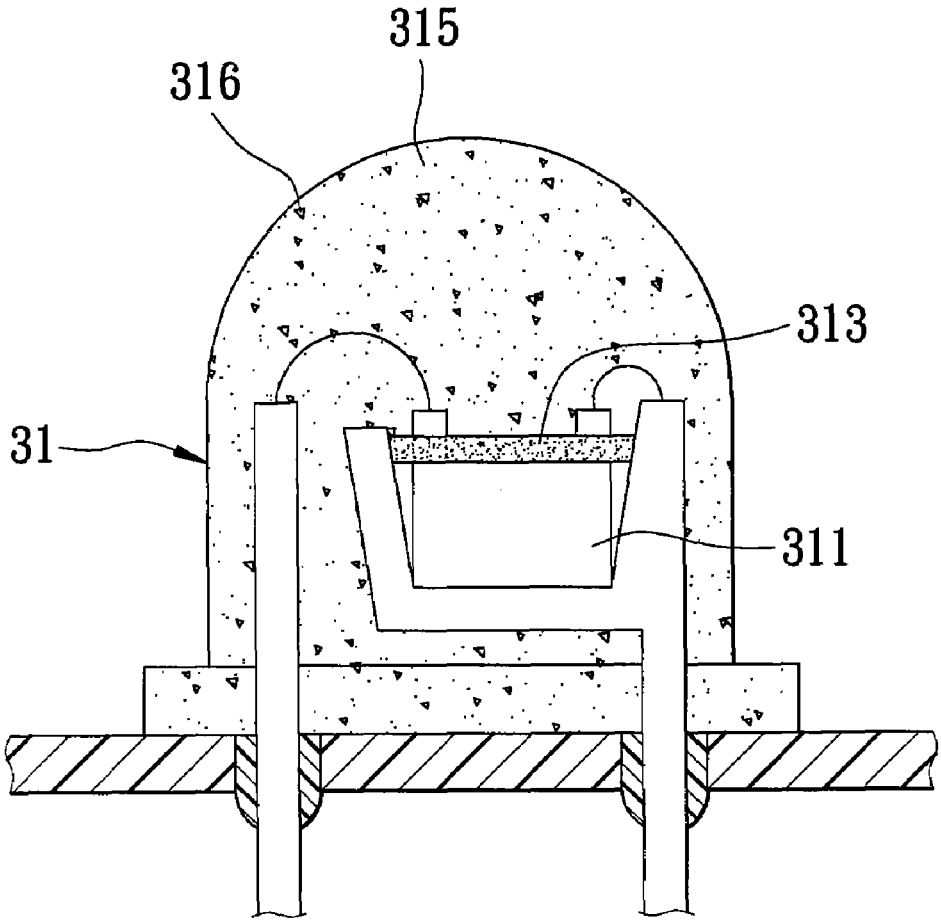
FIG. 4 is a fragmentary sectional view to illustrate a light emitting device of the first preferred embodiment.

Before the present invention is described in greater detail with reference to the accompanying preferred embodiments, it should be noted herein that like elements are denoted by the same reference numerals throughout the disclosure.

FIGS. 1 to 4 illustrate the first preferred embodiment of a light emitting assembly according to the present invention. The light emitting assembly includes: a heat sink 2 including a base wall 22 and two opposite retaining walls 21 extending upright from two opposite sides of the base wall 22 and defining respectively two retaining grooves 25, each of the retaining walls 21 having a top wall portion 211 confining a top side of a respective one of the retaining grooves 25; and a light emitting unit 3 mounted on the heat sink 2. The light emitting unit 3 includes a mounting seat 32 having two opposite wings 322 extending oppositely and respectively into the retaining grooves 25, and a light emitting device 31 mounted on the mounting seat 32 between the wings 322 and having a bottom wall 317 extending through the mounting seat 32 to abut against the base wall 22 of the heat sink 2. Each of the wings 322 of the mounting seat 32 is formed with an elastic protrusion 329 that abuts resiliently against the top wall portion 211 of a respective one of the retaining walls 21, thereby resulting in a pushing force acting on the mounting seat 32 to press the bottom wall 317 of the light emitting device 31 against the base wall 22 of the heat sink 2.

In this embodiment, the base wall 22 of the heat sink 2 is formed with a mesa 223 protruding therefrom and disposed between the retaining grooves 25. The bottom wall 317 of the light emitting device 31 contacts directly the mesa 223 of the base wall 22 of the heat sink 2. The base wall 22 of the heat sink 2 is formed with a plurality of first fins 231 opposite to the mesa 223. The top wall portion 211 of each of the retaining walls 21 is formed with a plurality of second fins 232. Each of the retaining walls 21 of the heat sink 2 has an inverted L-shaped cross-section.

A pair of insulating layers 41 are attached to the mesa 223 of the base wall 22 and are spaced apart from each other. A pair of conductive strips 51 are attached respectively to the insulating layers 41. The light emitting device 31 further has a semiconductor chip 311 with a pair of conductive terminals 331 contacting directly and respectively the conductive strips 51.

The mounting seat 32 further has a cylindrical reflector housing 321 having upper and lower ends 324, 323, and a frusto-conical reflecting wall 325 extending inwardly and downwardly from the upper end 324 of the reflector housing 321, having a bottom wall portion 327, and defining an accommodating space 326 therein. The wings 322 extend radially and oppositely from the lower end 323 of the reflector housing 321. The bottom wall portion 327 of the frusto-conical reflecting wall 325 is formed with a hole 3270. The light emitting device 31 extends fittingly through the hole 3270 in the bottom wall portion 327 of the frusto-conical reflecting wall 325, and further has a light-converting layer 313 of a fluorescent material, and a transparent encapsulant 315 that is disposed in the accommodating space 326 for passage of emitted light therethrough and that contains nano-scale particulate crystals 316. A light-scattering lens 34 is mounted in the accommodating space 326 in the frusto-conical reflecting wall 325.

A casing 6 is provided for accommodating the heat sink 2, the mounting seat 32, and the light emitting device 31, and has first and second casing halves 61, 62. The first casing half 61 cooperates with the second casing half 62 to define an inner space 63 therein, and is formed with a light-through opening 60 and a tubular confining wall 64 extending inwardly from a periphery of the light-through opening 60 into the inner space 63. The reflector housing 321 extends fittingly into the confining wall 64 of the first casing half 61. The second casing half 62 is formed with a retaining hole 621. The base wall 22 of the heat sink 2 is further formed with a fin-surrounding wall 24 that surrounds the first fins 231 of the base wall 22 of the heat sink 2 and that is fitted into the retaining hole 621 in the second casing half 62. The retaining walls 21 of the heat sink 2 and the second fins 232 are disposed in the inner space 63 in the casing 6.

In this embodiment, a circuit board 50 is mounted in the inner space 63 in the casing 6, and is connected electrically to the conductive strips 51. A rechargeable battery 52 is disposed in the inner space 63 in the casing 6, and is mounted on and is connected electrically to the circuit board 50. A power-connecting port 525 and a power-on indicator 524 are provided on the circuit board 50. A switch 523 with a switch-operating slide 527 is coupled electrically to the circuit board 50.

Figure 5:
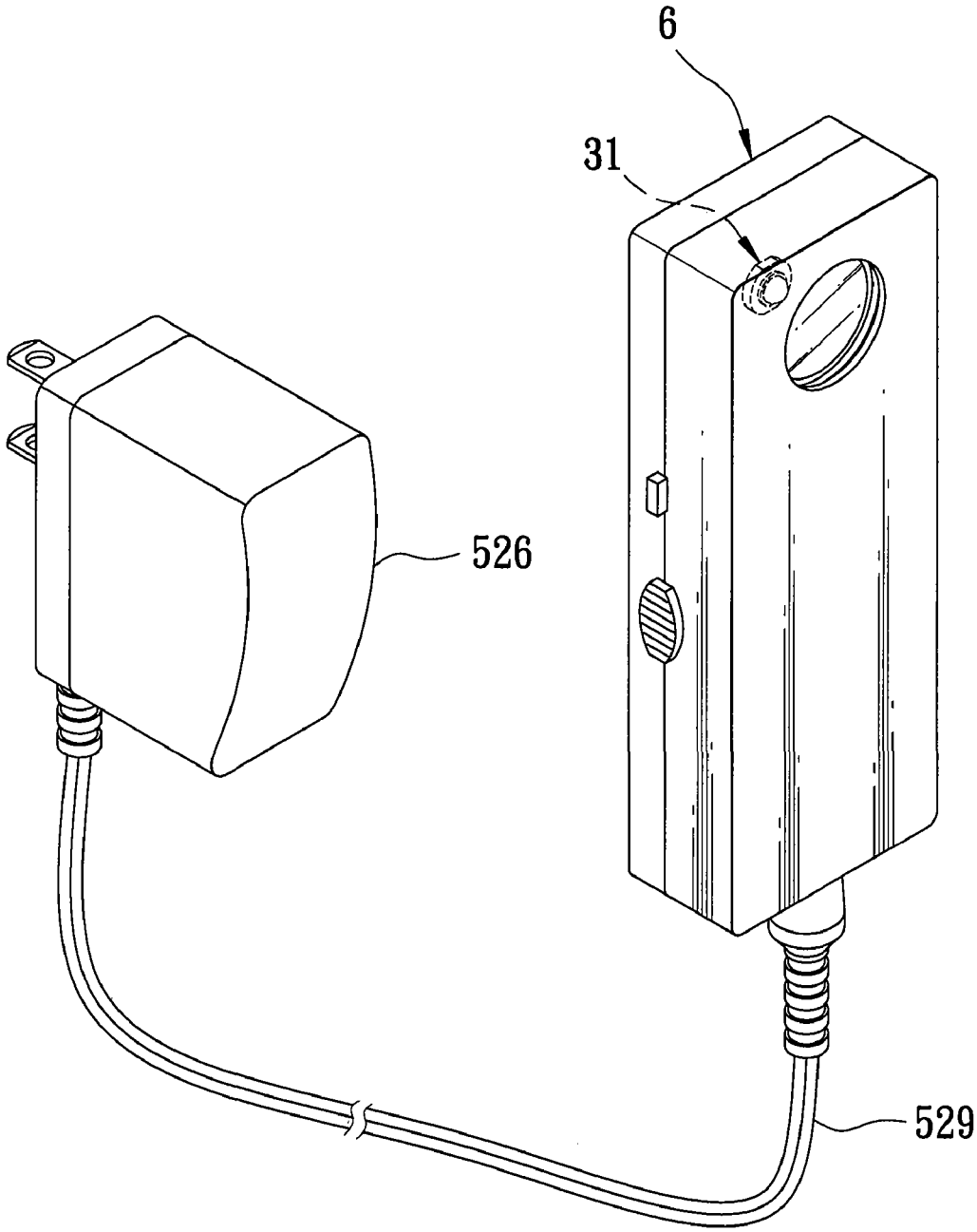
FIG. 5 is a perspective view of the second preferred embodiment of the light emitting assembly according to this invention.

FIG. 5 illustrates the second preferred embodiment of the light emitting assembly according to this invention.

The light emitting assembly differs from the previous embodiment by further including an adaptor 526 with a cord 529 that is connected electrically to the circuit board 50 through the power-connecting port 525 and that is adapted 5 to be connected to a power source (not shown), thereby permitting recharging of the rechargeable battery 52. The adaptor 526 is in the form of an AC/DC converter.

Figure 6:
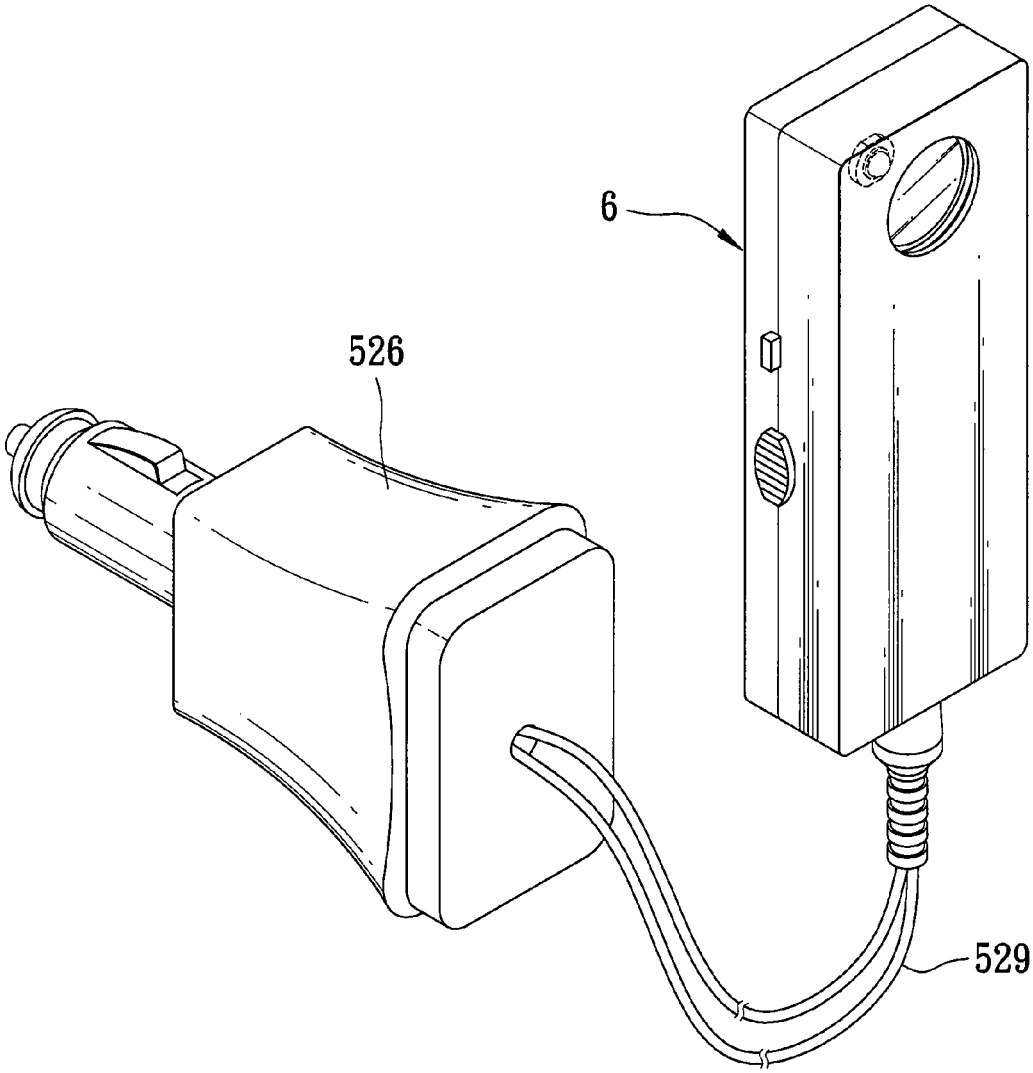
FIG. 6 is a perspective view of the third preferred embodiment of the light emitting assembly according to this invention.

FIG. 6 illustrates the third preferred embodiment of the light emitting assembly according to this invention. The light emitting assembly differs from the previous embodiment in that the adaptor 526 is in the form of a plug for connecting to a car lighter socket.

Figure 7:
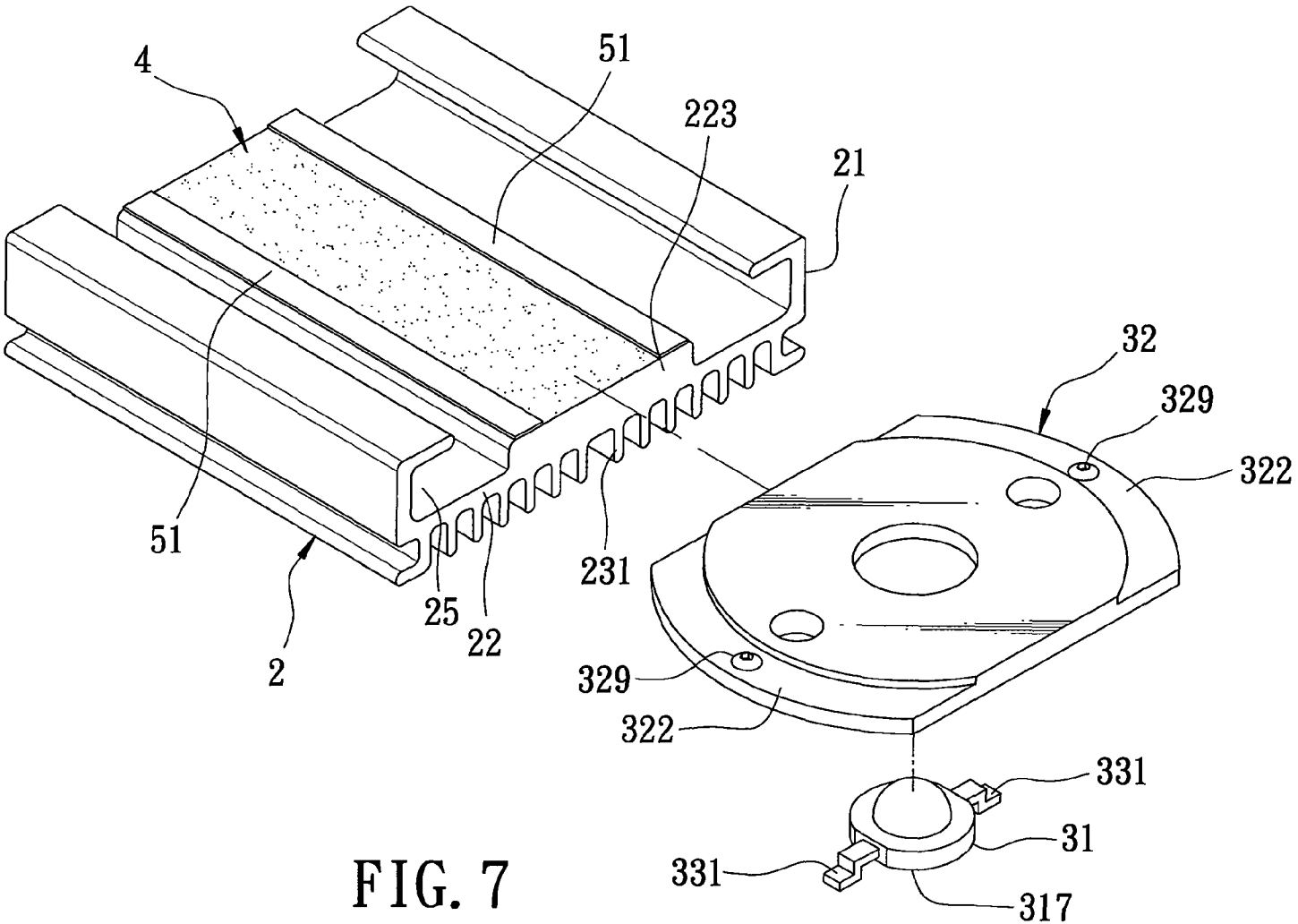
FIG. 7 is an exploded perspective view of the fourth preferred embodiment according to this invention, illustrating how a mounting seat is mounted on a heat sink with a diamond-like carbon film serving as an insulating layer.
Figure 8:
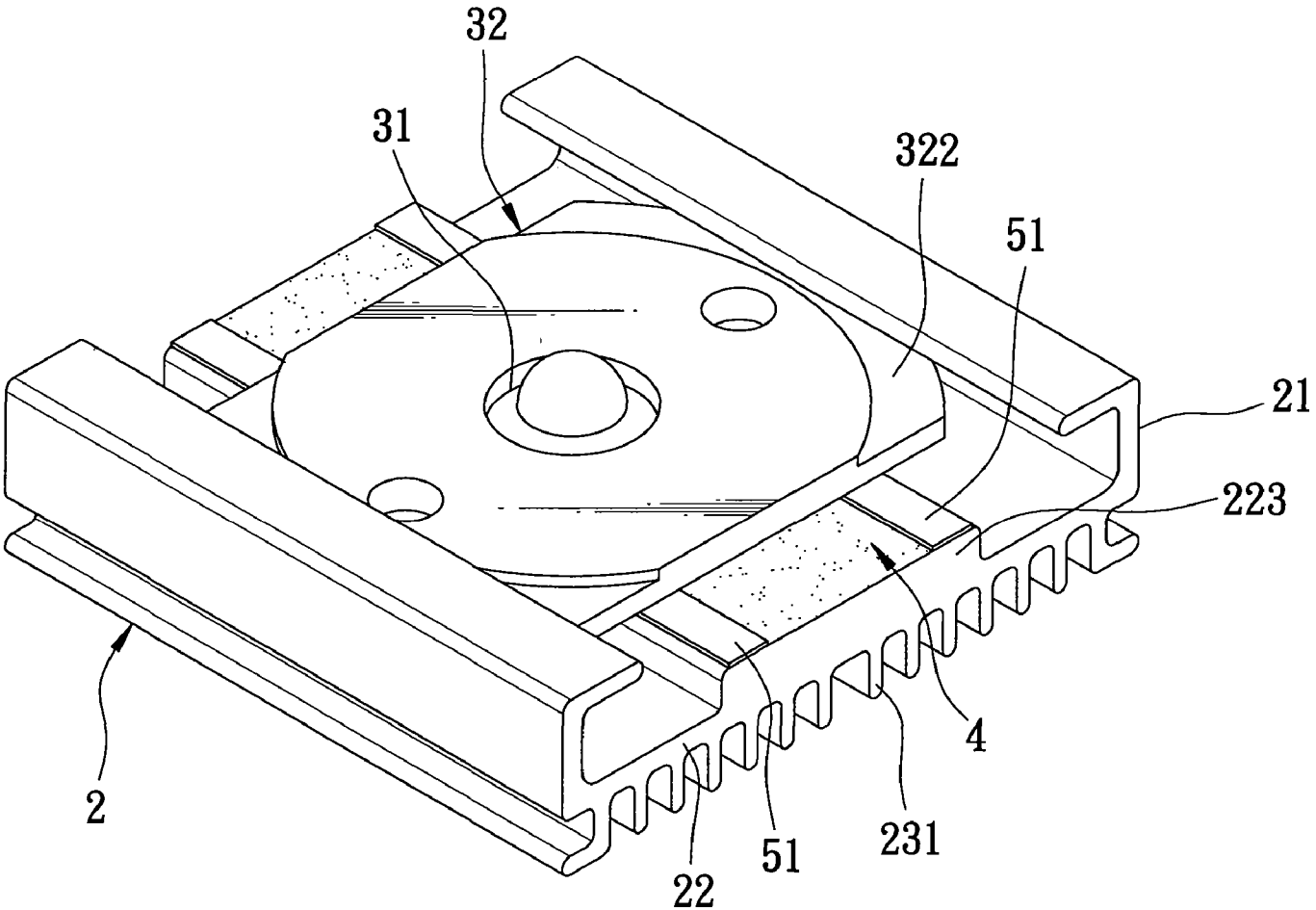
FIG. 8 is an assembled perspective view of the heat sink and the mounting seat of the fourth preferred embodiment.
Figure 9:
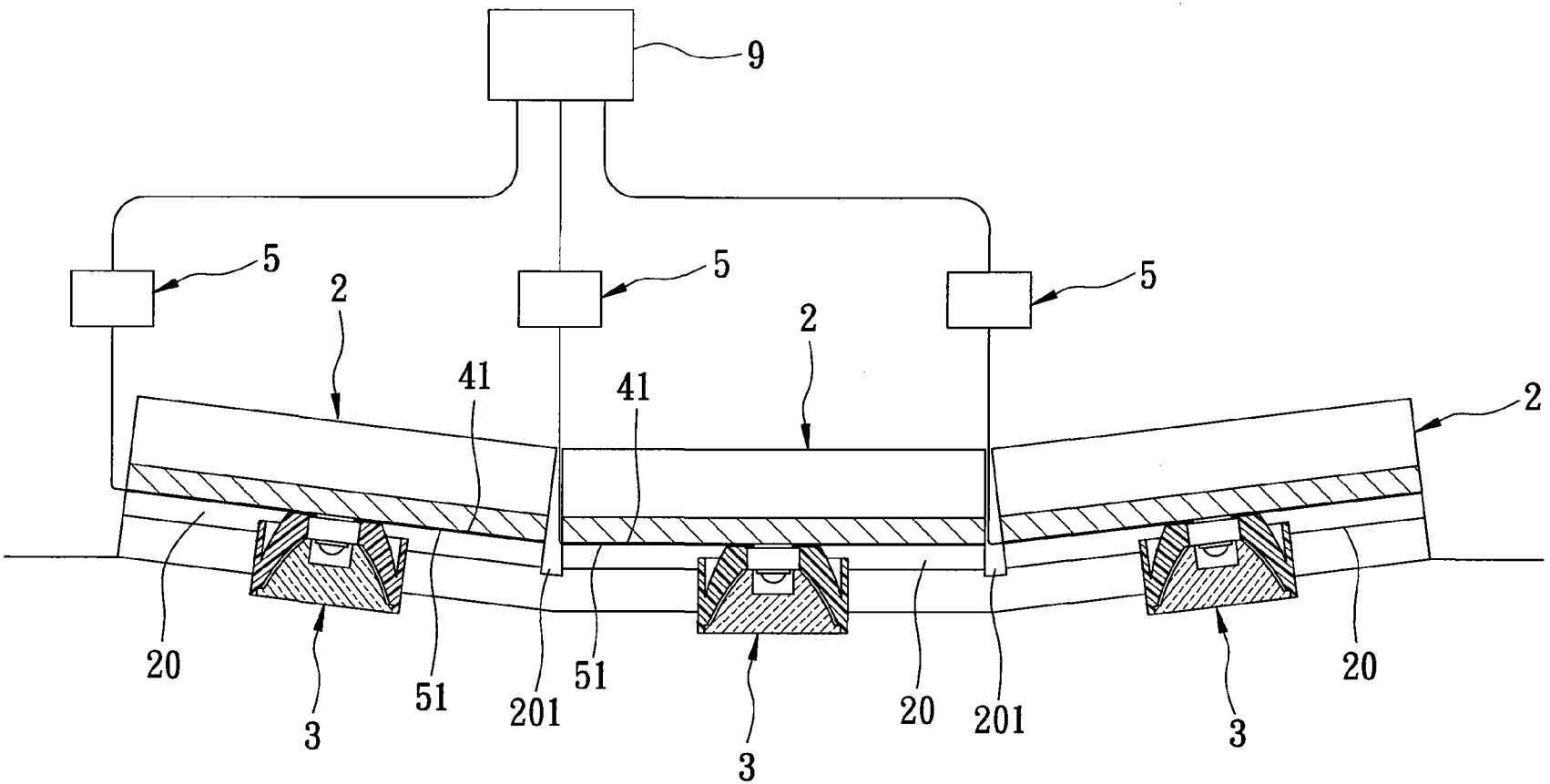
FIG. 9 is a fragmentary schematic sectional view of the fifth preferred embodiment of the light emitting assembly according to this invention.
Figure 10:
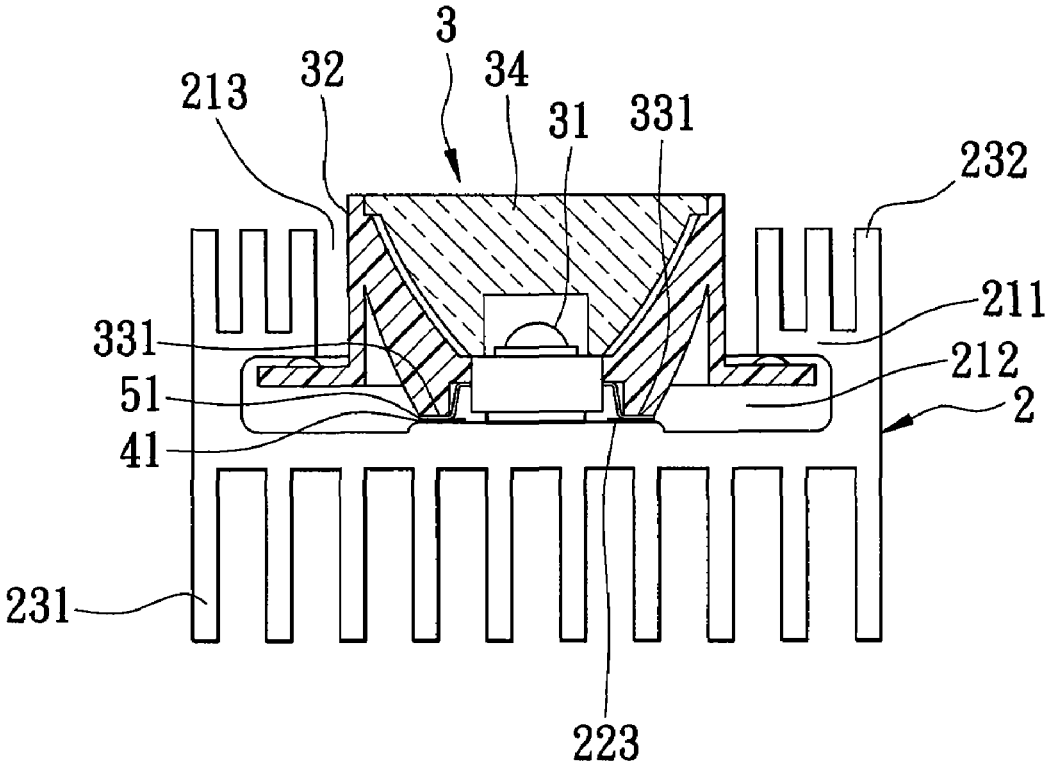
FIG. 10 is a partly sectional view of an assembled light emitting unit on the heat sink of the fifth preferred embodiment.
Figure 11:
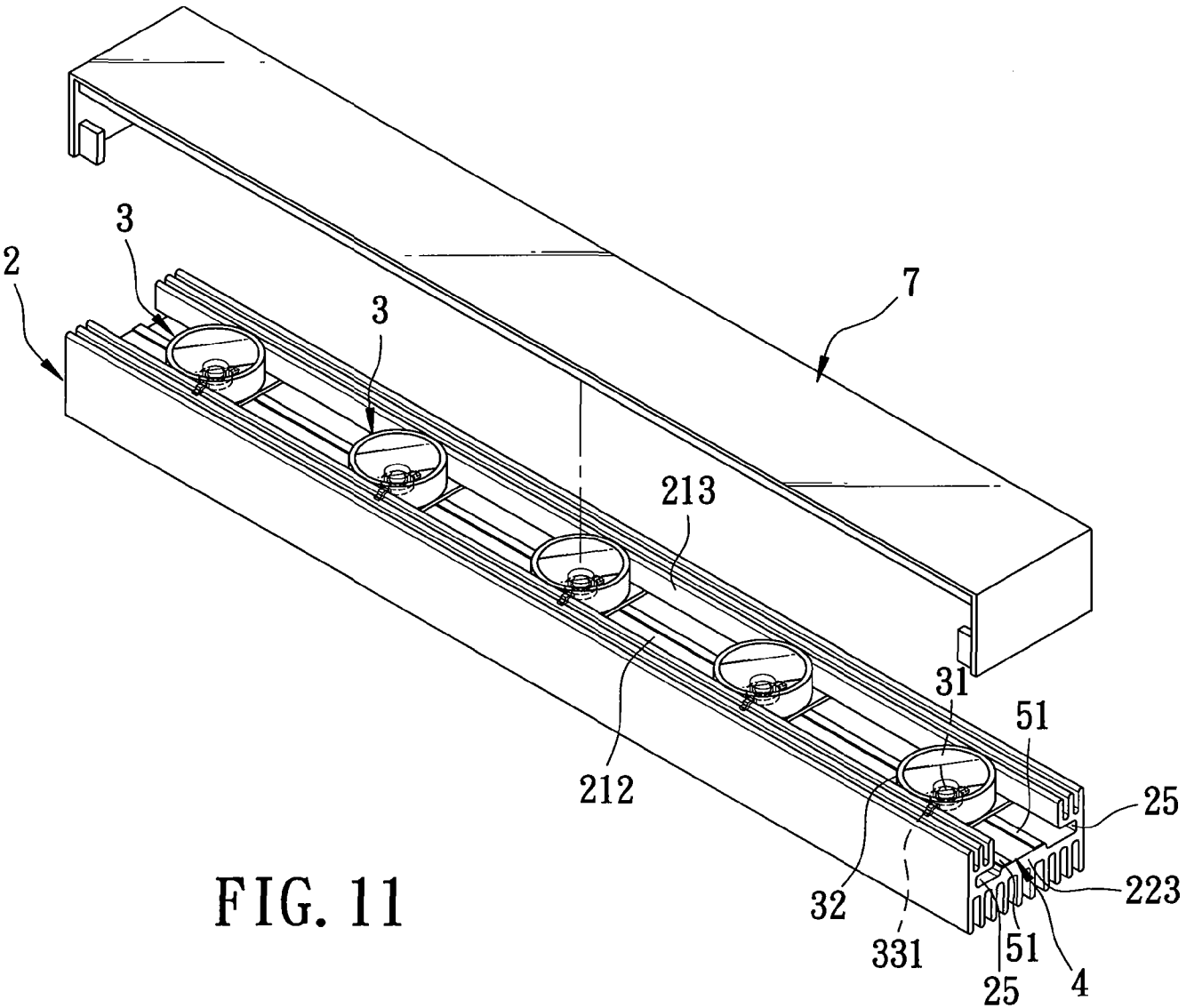
FIG. 11 is a partly exploded perspective view of the fifth preferred embodiment.
Figure 12:
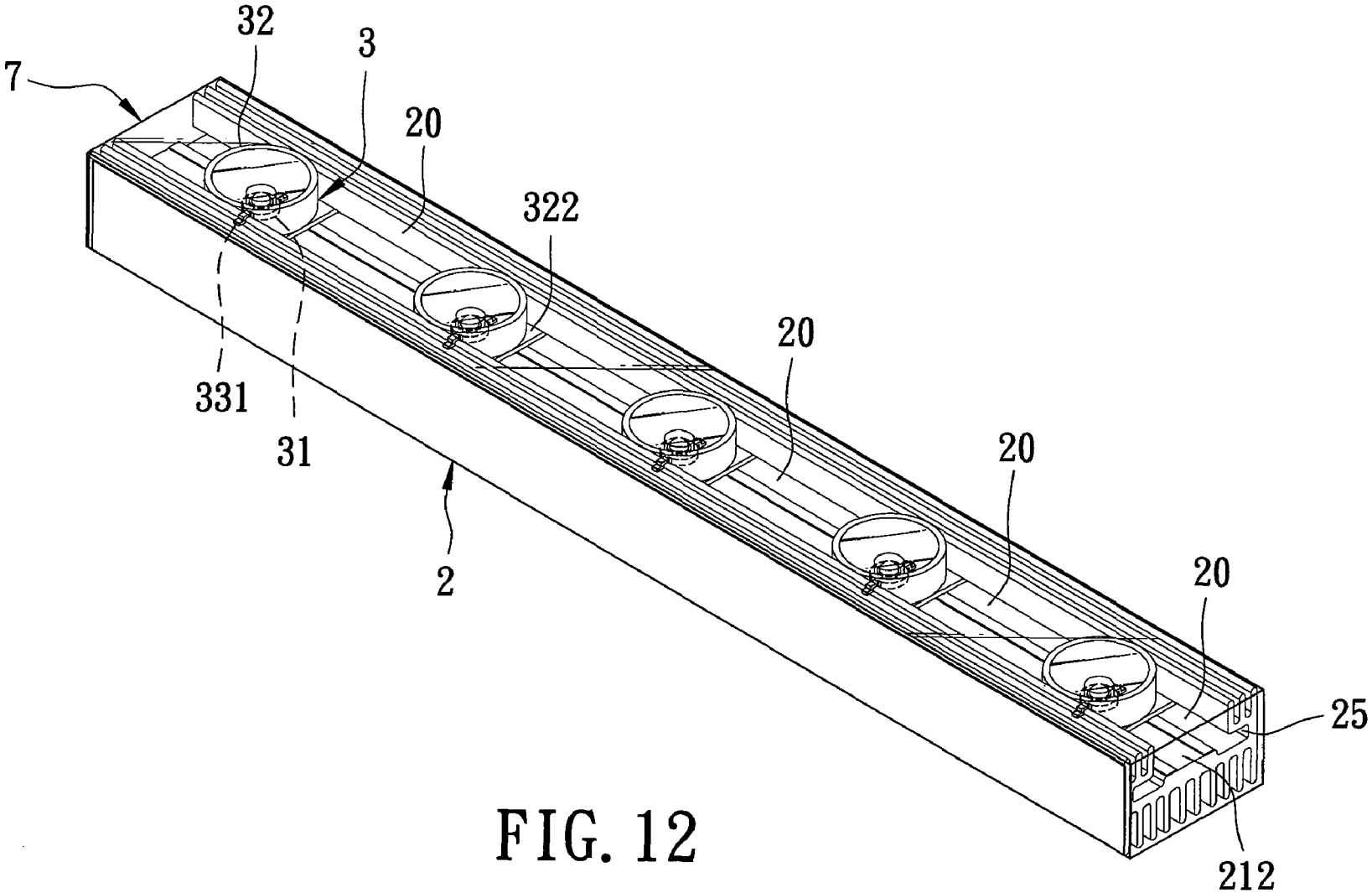
FIG. 12 is an assembled perspective view of the fifth preferred embodiment.

FIGS. 7 and 8 illustrate the fourth preferred embodiment of the light emitting assembly according to this invention. The light emitting assembly of this embodiment differs from the first preferred embodiment in that a high thermal conductive diamond-like carbon film 4 serves as an electrical insulating layer 41 to replace the aforesaid insulating layers 41 on the mesa 223 of the base wall 22 of the heat sink 2. In this embodiment, the diamond-like carbon film 4 covers the entire area of the mesa 223, and the bottom wall 317 of the light emitting device 31 is in direct contact with the diamond-like carbon film 4.

FIGS. 9 to 12 illustrate the fifth preferred embodiment of the light emitting assembly according to this invention. The light emitting assembly of this embodiment includes a heat sink 2 that has a structure similar to that of the heat sink 2 of the first preferred embodiment, except that the heat sink 2 is elongate and has an elongate base wall 22 extending in a longitudinal direction, and two opposite elongate retaining walls 21 extending upright from the base wall 22 and defining respectively two retaining grooves 25. The heat sink 2 is divided into a plurality of mounting zones 20 aligned along the longitudinal direction. A plurality of light emitting units 3, each of which has a structure similar to that of the light emitting unit 3 of the first preferred embodiment, are mounted on a respective one of the mounting zones 20 of the heat sink 2.

In this embodiment, a plurality of spaced apart slits 201 are formed in the heat sink 2 so as to divide the latter into the mounting zones 20 and so as to permit bending of the heat sink 2 at junctures between adjacent ones of the mounting zones 20.

The retaining walls 21 of the heat sink 2 cooperatively define a mounting space 212 and a top opening 213 therebetween. Each of the light emitting units 3 is disposed in the mounting space 212. A transparent cover 7 is mounted on the fins 232 of the top wall portions 211 of the retaining walls 21 of the heat sink 2 to cover the top opening 213 in the heat sink 2.

In this embodiment, the conductive strips 51 of each of the light emitting units 3 are connected to a power unit 5 which is connected to a power supply 9.

Figure 13:
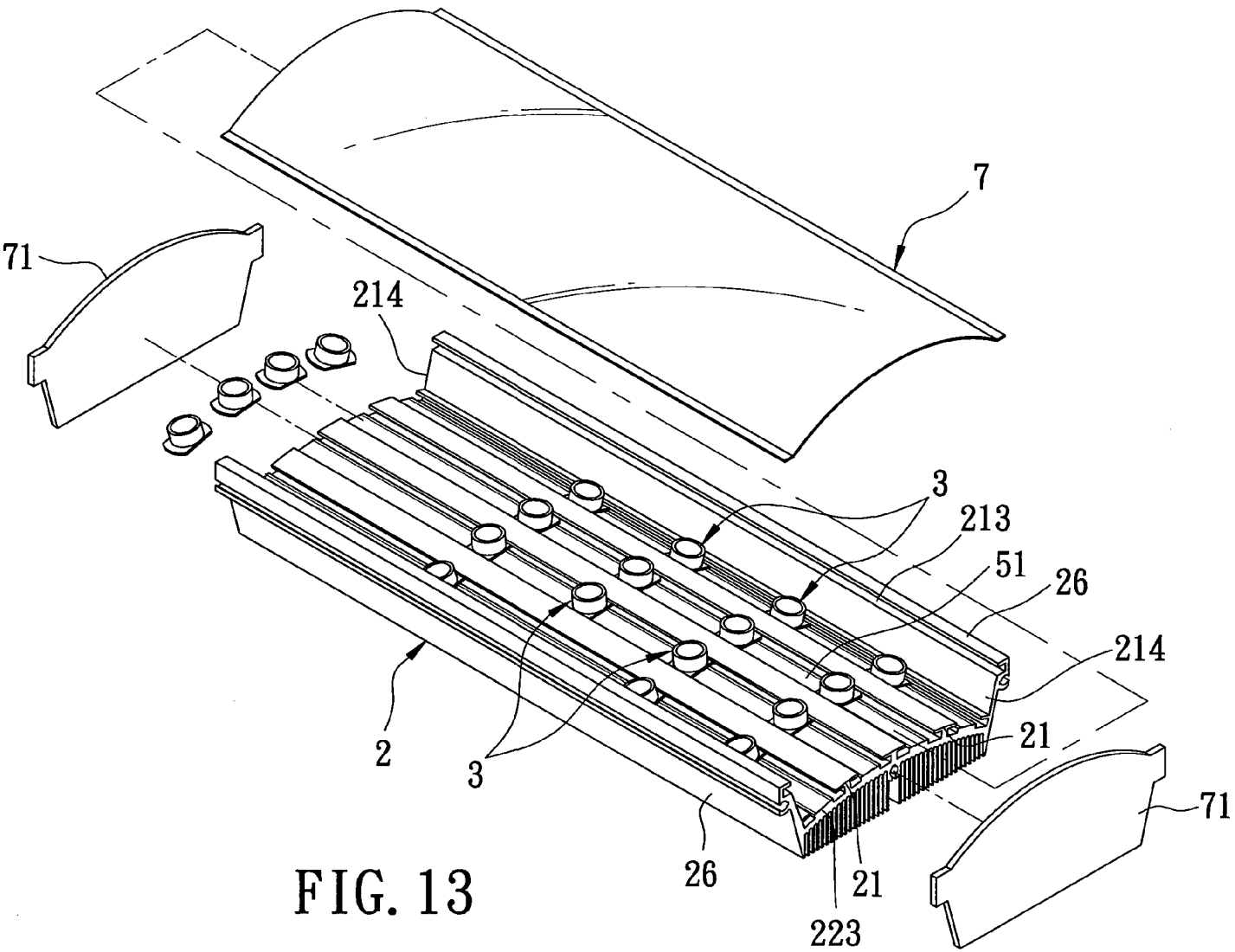
FIG. 13 is a partly exploded perspective view of the sixth preferred embodiment of the light emitting assembly according to this invention.
Figure 14:
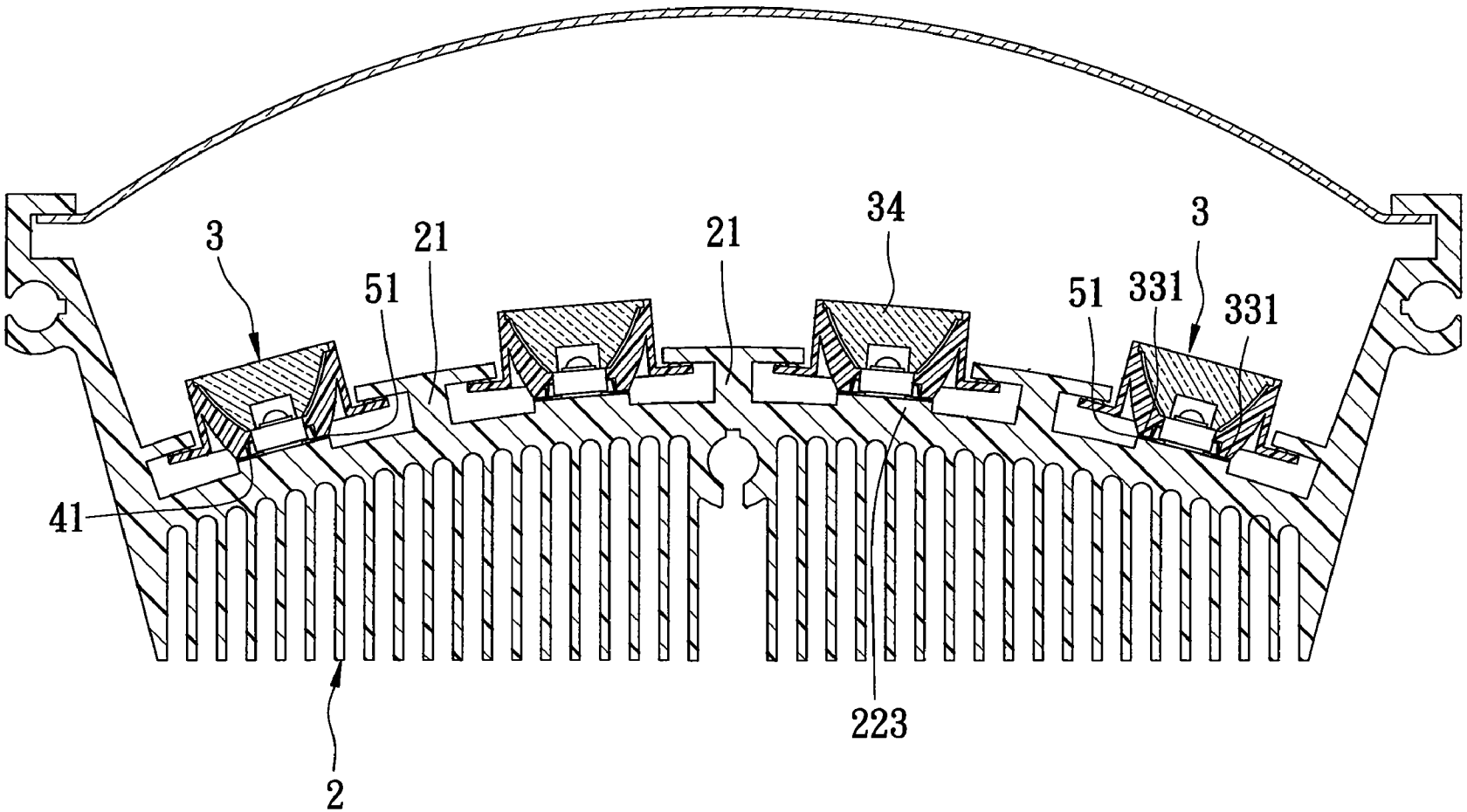
FIG. 14 is a partly section of view of the sixth preferred embodiment.

FIGS. 13 and 14 illustrate the sixth preferred embodiment of the light emitting assembly according to this invention. The light emitting assembly of this embodiment differs from the fifth preferred embodiment in that an array of the light emitting units 3 are mounted on the mounting zones 20 of the heat sink 2, that a plurality of parallel retaining walls 21 extend upright from the base wall 22, and that each of the retaining walls 21 of the heat sink 2 has a T-shaped cross-section.

In this embodiment, the heat sink 2 further has two opposite side walls 26 extending upright from two opposite sides of the base wall 22, and cooperatively defining a top opening 213 and two end openings 214. The retaining walls 21 are disposed between the side walls 26. A top cover 7 is provided to cover the top opening 213 in the heat sink 2. In addition, two end covers 71 are provided to cover the end openings 214 in the heat sink 2, respectively.

Figure 15:
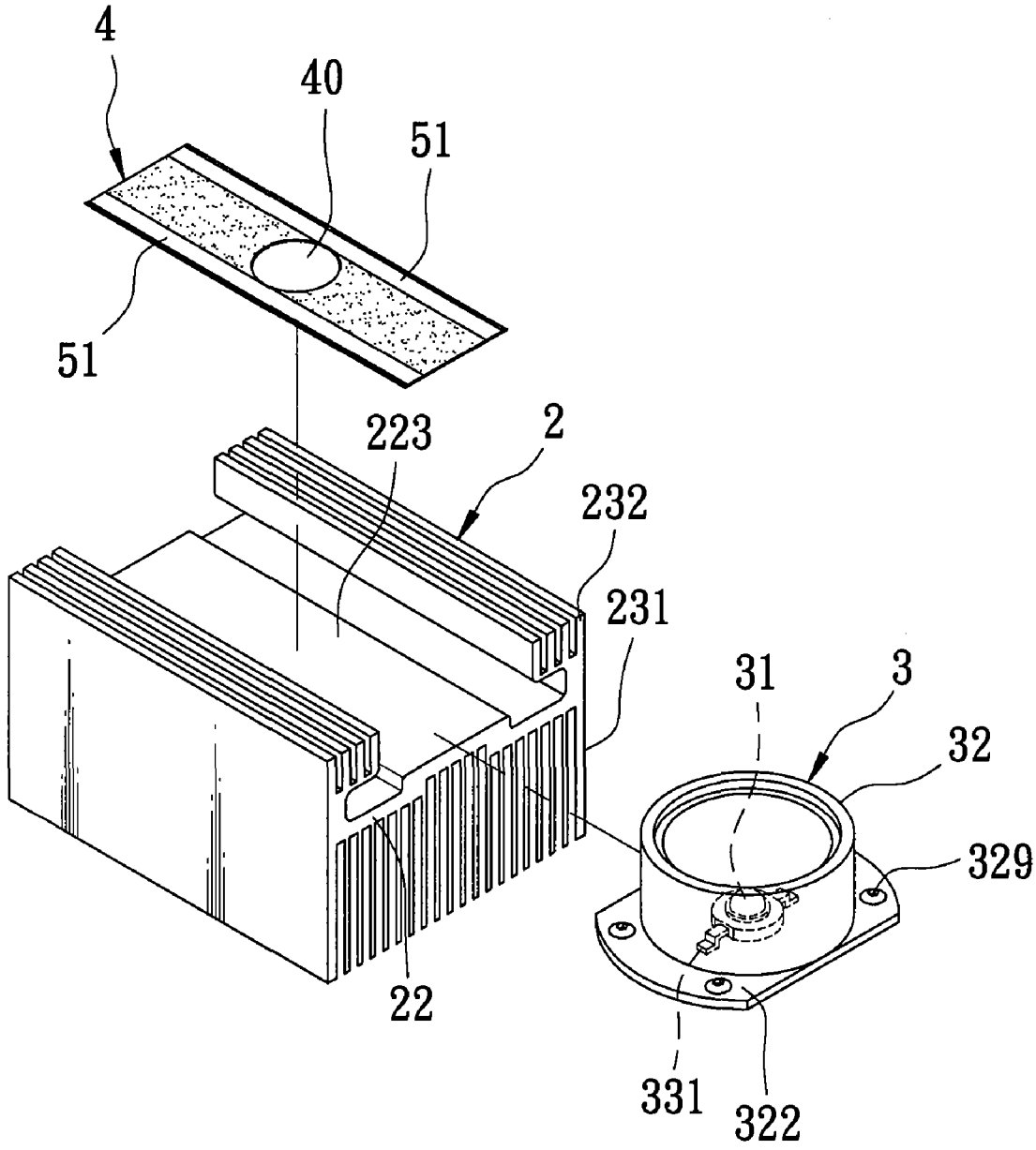
FIG. 15 is an exploded perspective view of the seventh preferred embodiment of the light emitting assembly according to this invention.

FIG. 15 illustrates the seventh preferred embodiment of the light emitting assembly according to this invention. The light emitting assembly of this embodiment differs from the embodiment of FIG. 7 in that the diamond-like carbon film 4 is formed with a through-hole 40 so as to permit the bottom wall 317 of the light emitting device 31 to contact directly the mesa 223 of the base wall 22 of the heat sink 2. Alternatively, referring back to FIG. 3, the insulating layers 41 can be formed on the mesa 223 of the base wall 22 of the heat sink 2 by forming a deposited oxidized film through electro-deposition and anode oxidation treatment of the deposited film.

Since the wings 322 of the mounting seat 32 can be easily slid into the retaining grooves 25 in the retaining walls 21 of the heat sink 2, assembly of the light emitting unit 3 to the heat sink 2 is facilitated and replacement of the light emitting unit 3 is relatively convenient. Moreover, with the inclusion of the elastic protrusions 329 in the light emitting unit 3 of the light emitting assembly of this invention, heat dissipating efficiency of the light emitting assembly can be considerably enhanced.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A light emitting assembly comprising:

a heat sink including a base wall and two opposite retaining walls extending upright from said base wall and defining respectively two retaining grooves, each of said retaining walls having a top wall portion confining a top side of a respective one of said retaining grooves;

a mounting seat having two opposite wings extending oppositely and respectively into said retaining grooves;

a light emitting device mounted on said mounting seat between said wings and having a bottom wall extending through said mounting seat to abut against said base wall of said heat sink; and a casing having first and second casing halves;

wherein each of said wings of said mounting seat is formed with an elastic protrusion that abuts resiliently against said top wall portion of a respective one of said retaining walls, thereby resulting in a pushing force acting on said mounting seat to press said bottom wall of said light emitting device against said base wall of said heat sink;

wherein said mounting seat further has a cylindrical reflector housing having upper and lower ends, and a frusto-conical reflecting wall extending inwardly and downwardly from said upper end of said reflector housing, said frusto-conical reflecting wall having a bottom wall portion and defining an accommodating space therein, said wings extending radially and oppositely from said lower end of said reflector housing, said bottom wall portion of said frusto-conical relecting wall being formed with a hole, said light emitting device extending fittingly through said hole in said bottom wall portion of said frusto-conical reflecting wall, and further having a transparent encapsulant that is disposed in said accommodating space for passage of emitted light therethrough; and wherein said first casing half cooperates with said second casing half to define an inner space therein, said first casing half being formed with a light-through opening and a tubular confining wall extending inwardly from a periphery of said light-through opening into said inner space, said reflector housing extending fittingly into said confining wall of said first casing half, said second casing being formed with a retaining hole, said base wall being further formed with a fin-surrounding wall that surrounds said first fins of said base wall of said heat sink and that is fitted into said retaining hole in said second casing half, said retaining walls of said heat sink being disposed in said inner space in said casing.

2. The light emitting assembly of claim 1, wherein said base wall of said heat sink is formed with a mesa protruding therefrom and disposed between said retaining grooves, said bottom wall of said light emitting device contacting directly said mesa of said base wall of said heat sink.

3. The light emitting assembly of claim 2, wherein said base wall of said heat sink is formed with a plurality of first fins opposite to said mesa.

4. The light emitting assembly of claim 3, further comprising a pair of insulating layers attached to said mesa of said base wall and spaced apart from each other, and a pair of conductive strips attached respectively to said insulating layers, said light emitting device further having a pair of conductive terminals contacting respectively said conductive strips.

5. The light emitting assembly of claim 1, further comprising a light-scattering lens mounted in said accommodating space in said frusto-conical reflecting wall.

6. The light emitting assembly of claim 1, wherein said top wall portion of each of said retaining walls is formed with a plurality of second fins disposed in said inner space.

7. The light emitting assembly of claim 1, further comprising a circuit board mounted in said inner space in said casing and connected electrically to said conductive strips, and a battery disposed in said inner space in said casing and mounted on and connected electrically to said circuit board.

8. The light emitting assembly of claim 7, further comprising an adaptor connected electrically to said circuit board and adapted to be connected to a power source.

9. The light emitting assembly of claim 1, wherein each of said retaining walls of said heat sink has an inverted L-shaped cross-section.

10. The light emitting assembly of claim 1, wherein said base wall of said heat sink is formed with a mesa protruding therefrom and disposed between said retaining grooves, said light emitting assembly further comprising an insulating layer of a diamond-like carbon film attached to said mesa of said base wall, and a pair of opposite conductive strips attached to said insulating layer and spaced apart from each other, said light emitting device further having a pair of conductive terminals contacting respectively said conductive strips, said bottom wall of said light emitting device contacting directly said insulating layer.

* * * * *